US007823858B2

(12) United States Patent
Matsufuji et al.

(10) Patent No.: US 7,823,858 B2
(45) Date of Patent: Nov. 2, 2010

(54) METHOD FOR FORMING MASONRY UNIT

(75) Inventors: Yasunori Matsufuji, Fukuoka (JP); Tomoyuki Koyama, Fukuoka (JP)

(73) Assignee: Japan Science and Technology Agency, Kawaguchi (JP)

( * ) Notice: Subject to any disclaimer, the term of this patent is extended or adjusted under 35 U.S.C. 154(b) by 284 days.

(21) Appl. No.: 11/988,025

(22) PCT Filed: Jun. 28, 2005

(86) PCT No.: PCT/JP2005/012283

§ 371 (c)(1),
(2), (4) Date: Dec. 28, 2007

(87) PCT Pub. No.: WO2007/000827

PCT Pub. Date: Jan. 4, 2007

(65) Prior Publication Data

US 2009/0100790 A1 Apr. 23, 2009

(51) Int. Cl.
*B22C 9/24* (2006.01)

(52) U.S. Cl. ..... 249/151; 249/149; 52/606; 52/747.12; 52/562

(58) Field of Classification Search ..... 52/600, 52/606, 585.1, 285.2, 747.1, 248, 747.12, 52/565, 562, 605, 233; 249/102, 104, 155, 249/151, 149

See application file for complete search history.

(56) References Cited

U.S. PATENT DOCUMENTS 3,875,278 A 4/1975 Brandt
4,957,685 A 9/1990 Boot
4,963,305 A * 10/1990 Cromrich et al. ..... 264/644
5,145,281 A * 9/1992 Molyneux ..... 405/184.2
5,249,950 A * 10/1993 Woolford ..... 425/412
6,282,859 B1 * 9/2001 Van Der Heijden ..... 52/585.1
6,915,614 B2 * 7/2005 Matsufuji ..... 52/600
7,267,321 B1 * 9/2007 Morrell ..... 249/102
7,367,752 B2 * 5/2008 Price ..... 405/284
7,546,712 B2 * 6/2009 Shaw ..... 52/223.8
2002/0014050 A1 2/2002 Van Der Heijden
2004/0020145 A1 2/2004 Matsufuji
2005/0252118 A1 11/2005 Matsufuji

FOREIGN PATENT DOCUMENTS

FR 2574339 6/1986

(Continued)

*Primary Examiner*—Richard E Chilcot, Jr.
*Assistant Examiner*—Chi Nguyen
(74) *Attorney, Agent, or Firm*—Jacobson Holman PLLC

(57) ABSTRACT

Masonry units (10) are integrally assembled by tightening forces of bolts (60) and nuts (70), in a condition that interlayer metal plates (50) are interposed between the masonry units. A basic form (11) of the masonry unit is contained in a mold for forming the masonry unit. A space (98) for fluidic covering material, which is chargeable with the covering material, is defined between upper and lower faces of the form (11), and the fluidic covering material is charged in the space. The upper and lower faces of the masonry unit are covered with the solidified covering material (12). According to the present invention, high dimensional accuracy of the masonry unit can be ensured, and efficiency of the production process of the masonry units is promoted to improve productivity of the masonry units.

15 Claims, 15 Drawing Sheets

FOREIGN PATENT DOCUMENTS

| | | |
|---|---|---|
| FR | 2725150 | 4/1996 |
| JP | 53-073826 | 6/1978 |
| JP | 62-256607 | 11/1987 |
| JP | 5-255982 | 10/1993 |
| JP | 05-285930 | 11/1993 |
| JP | 6-299621 | 10/1994 |
| JP | 07-109780 | 4/1995 |
| JP | 7-229215 | 8/1995 |
| JP | 08-001622 | 1/1996 |
| JP | 9-21199 | 1/1997 |
| JP | 9-235801 | 9/1997 |
| JP | 2000-190313 | 7/2000 |
| JP | 2001-521594 | 11/2001 |
| JP | 2002-081152 | 3/2002 |
| WO | WO 2004/011734 | 2/2004 |

* cited by examiner

METHOD FOR FORMING MASONRY UNIT

This is a national stage of International application no. PCT/JP2005/012283 filed on Jun. 28, 2005 and published in Japanese.

TECHNICAL FIELD

The present invention relates to a method of forming a masonry unit, and more specifically, to such a method for producing the masonry unit which is used in a dry type of masonry construction method utilizing mechanical tightening force.

TECHNICAL BACKGROUND

A variety of architectural structures are known in the art, such as wooden structure, reinforced concrete structure, steel structure and so forth. As a kind of such an architectural structure, a masonry structure is known, in which walls and so forth are constructed by laying or stacking masonry units such as bricks or concrete blocks.

Bricks produced by baking a quantity of brick clay at a high temperature are highly evaluated by their architectural design effects or aesthetic effects resulting from their textures, stately appearances, feelings, colors and so forth. The bricks also exhibit their excellent physical performance with respect to durability, sound insulation effect, fire resistance efficiency, heat accumulation effect and so forth. Therefore, the bricks have been popularly used worldwide for a long time and widely employed as materials for architectural wall structures. Further, precast concrete products applicable to a masonry method, such as concrete blocks, exhibit relatively excellent performance with respect to economical efficiency, workability, durability, fire resistance efficiency and so forth. In recent years, designs for improving their architectural design effectiveness and reliability are appropriately employed, and therefore, the precast concrete products are widely and practically used for construction of walls.

In general, the masonry units, such as bricks, concrete blocks or the like, are laid by applying fresh mortar to the laying face. Accuracy of masonry, such as correctness to relative positions, intervals, levels and so forth, are adjusted timely during the masonry process. This kind of conventional masonry structure falls under a wet type of construction method.

On the other hand, the present inventor has proposed DUP (Distributed and Unbonded Prestress) Construction Method as a dry type of bricklaying construction method. According to this construction method, bricks are stacked in a multi-layered condition while pre-stress is introduced into the bricks by mechanical tightening force of metallic bolts, whereby a wall and the like having an earthquake resistant bricklaying structure can be constructed (Japanese patent applications Nos. 4-51893, 5-91674, 6-20659, 7-172603 and 8-43014).

The present inventor still continues the study for practical application of the DUP Construction Method. For example, in Japanese patent application No. 2000-270219 (Japanese patent laid-open publication No. 2002-81152), the present inventor has proposed the method in which a bolt hole and a large diameter hollow section are formed in position of a brick, whereby various intricate parts of wall structures can be constructed by the bricks having a common configuration and dimension. The present inventor has also proposed a Grid Method for enabling methodical and prompt design of distribution of the constituents used for the DUP Construction Method, in PCT international application No. PCT/JP03/09730. Further, the present inventor has proposed a double wall type of wall structure in which a brick wall built by the DUP Construction Method and an inner wall built by a dry type of construction method are connected for transmission of stress with each other by a shear reinforcement member.

Such a bricklaying method is a dry construction type of masonry method in which the bricks are integrally assembled by mechanical tightening force of nuts and bolts. This method has achieved its intended purpose, such as considerable reduction in construction time, compared with a conventional wet type of bricklaying construction method. However, according to this method, the walls, columns and so forth are built by fastening the bricks with the nuts and bolts, and therefore, adjustment of accuracy of masonry by fresh mortar can not be carried out. Thus, highly accurate dimensions of the bricks themselves are required. For instance, the vertically adjacent bricks are laid while the interlayer metal plate is interposed between the upper and lower bricks. Therefore, the upper and lower faces of the bricks in contact with the metal plate should be flat, smooth and horizontal with high accuracy. The height of each of the bricks should be dimensionally highly accurate as well. At present, the standard deviation of the accuracy with respect to the upper and lower faces of the brick (the target value as to the accuracy of the height of the brick) is set to be 0.118 mm, and the standard deviation of the accuracy with respect to the end faces of the brick (the target value as to the accuracy of the length of the brick) is set to be 0.142 mm.

Under such circumstances, the lying faces (the upper and lower faces) of the brick for the DUP Construction Method is ground in the production process, whereby horizontality, flatness and dimensional accuracy can be attained. If desired, the end face or both end faces of the brick are also ground in the production process for verticality, flatness and dimensional accuracy.

However, the steps for grinding the bricks after baking cause losses of water and energy for grinding, and the steps for grinding the bricks also result in losses of productivity and inexpensiveness of the bricks since the steps complicate the production process, waste time, cause addition of work or steps, increase production costs including labor costs, and create a shavings disposal problem and so forth. Thus, it is necessary to ensure high dimensional accuracy, flatness and horizontality (or verticality) of the lying faces (and the end faces) of the brick without the aforementioned grinding steps, thereby improving the productivity and inexpensiveness.

Further, each of the bricks for the DUP Construction Method is provided with through-holes having large and small diameters for accommodating a nut and a bolt respectively. Therefore, it is necessary to precisely bore the baked bricks in order to make two kinds of through-holes with different diameters. However, such boring steps for making these holes also cause losses of productivity and inexpensiveness of the bricks. If such through-holes can be formed on the brick by a relatively simplified step, productivity and inexpensiveness of the bricks would be able to be further improved.

Such problems are not limited to the bricks for the DUP Construction Method, but those problems would be also recognized similarly with respect to concrete blocks laid in accordance with the DUP Construction Method or a similar dry type of construction method.

The object of the present invention is to provide a method for forming a masonry unit used for a dry type of construction method utilizing mechanical tightening force of nuts and bolts, which can ensure high dimensional accuracy of each of the masonry units and promote efficiency of the production process of the masonry units, thereby improving productivity of the masonry units.

Particularly, the present invention is directed toward promotion of efficiency of production process of bricks used for the DUP Construction Method and improvement of productivity of these bricks.

DISCLOSURE OF THE INVENTION

The present invention provides a method for forming a masonry unit to be used for a dry type of masonry construction method in which a metal plate (50) is interposed between upper and lower masonry units (10;10';10") and the upper and lower masonry units are integrally assembled by tightening force of fastening elements (60,70), wherein said masonry unit is contained in a mold; a space for charging covering material, which is chargeable with the fluidic covering material, is defined between upper and lower faces of said masonry unit and surfaces of the mold; and the fluidic covering material is charged in said space so that the upper and lower faces of said masonry unit are covered with the solidified covering material.

According to this arrangement of the present invention, the upper and lower faces of the masonry unit are covered with the solidified covering material. The accuracy of surface of the solidified material depends on the accuracy of the surface of the mold. Therefore, a number of masonry units with the upper and lower faces improved in their dimensional accuracy can be produced with use of the prefabricated mold with high dimensional accuracy. Thus, high dimensional accuracy (the standard deviation=approx. 0.1 mm), flatness and horizontality of the lying faces are ensured without grinding of the lying faces (the upper and lower faces), whereby the productivity and inexpensiveness can be improved.

The present invention also provides a method with the aforementioned arrangement, wherein the masonry unit having a through-hole is contained in the mold; a core is inserted into the through-hole; and the upper and lower faces of the masonry unit and an inner wall surface of the through-hole are simultaneously covered with the solidified covering material.

According to such an arrangement of this invention, the masonry unit is formed with the through-hole which is covered with the solidified covering material on its inner circumferential surface. The position and inner diameter of the hole depends on the position and outer diameter of the core, and the accuracy of the inner surface of the hole relies on the accuracy of an outer circumferential surface of the core. Therefore, it is not necessary to precisely make a through-hole in its final position and dimensions on the masonry unit (the blank or basic form of the masonry unit) to be inserted into the mold, but the unfinished through-hole (the basic through-hole) with an approximate dimension may be formed at an approximate position enclosing the final position of the hole. As the final dimension, position and accuracy of the hole depend on those of the core, the basic through-holes may have an equal or equivalent dimension and configuration, regardless of their final dimension, position and accuracy. Therefore, it is possible to omit a boring step for precisely or strictly boring the masonry unit with high accuracy, thereby further improving the productivity and inexpensiveness of the masonry units.

Further, the present invention provides a method with the aforementioned arrangement, wherein a brick having a generally rectangular profile is used as the masonry unit to be contained in the mold. The masonry unit, which has the lying face finished to be flat, smooth and horizontal by the solidified covering material, can be precisely laid by means of the interlayer metal plates, even though the grinding step is omitted. In addition, such masonry units are integrally assembled to be a dry type of masonry structure with high accuracy, by means of mechanical tightening forces of the nuts and bolts. Therefore, the masonry units formed in accordance with this forming method can be preferably used as the bricks for the DUP Construction Method.

Furthermore, the present invention provides a method with the aforementioned arrangement, wherein a brick having a plurality of through-holes is used as the masonry unit (the blank or basic form of the masonry unit) to be contained in the mold. According to such a method, a brick, in which a plurality of equivalent through-holes with a relatively large inner-diameter is formed during the brick baking process in accordance with conventional technique, can be used as the blank or basic form of the masonry unit. Through-holes having desired dimensions, each accommodating a bolt, a nut and so forth, can be formed by the solidified covering material.

In general, the hole formed in the brick baking process is decreased in positional and dimensional accuracy. It is difficult to use the hole of the brick formed in the brick baking process, as a hole of the brick for the DUP Construction Method. However, in a case where the inner surface of the hole can be covered with the covering material simultaneously with covering of the upper and lower surfaces, the through-hole and the bolt hole applicable to the DUP Construction Method can be formed in a conventional brick with high accuracy.

If desired, one of the through-holes, into which the core is not inserted, may be filled with the covering material, owing to absence of the core therein. According to such a method, setting of the number and positions of the holes can be appropriately changed.

In a preferred embodiment of the present invention, when the masonry unit is contained in the mold, a space chargeable with the fluidic covering material is further defined between each of the end faces and the surface of the mold. Preferably, the space is in communication with the aforementioned space between the upper and lower surfaces and the surfaces of the mold. According to such an arrangement, the end face of the brick is also covered with the solidified covering material. The accuracy of the relative position of adjacent masonry units can be improved and the vertical joints can be precisely and relatively easily formed between the units.

In another preferred embodiment of the present invention, the mold is a metal mold such as a steel mold. A mold made from resin, ceramics or the like may be used as this mold, in so far as it has strength enough to endure a charging pressure of the covering material. Preferably, the mold is constituted from upper and lower mold parts. The lower mold part comprises a rectangular frame having four faces corresponding to the upper, lower and end faces of the brick, and a bottom plate which can be combined with the frame for lifting motion. The upper mold part closes a top opening of the lower mold part in a condition that the body (the blank or basic form) is contained in the lower mold part. A cavity for injection of the fluidic covering material under pressure is defined in the mold. Preferably, the mold is provided with a covering material injection gate, which is connected with a supply source of the fluidic covering material by means of a material delivery pipeline equipped with means for injecting or pressurizing the material, such as a pump.

Preferably, a vertical wall of the lower mold part is formed with an opening for insertion of the core. The core is inserted into the opening so that the core extends through the through-hole of the masonry unit. A second space to be charged with the covering material is defined between an outer surface of the core and an inner surface of the hole. The fluidic covering material injected into the space as previously described is also charged in this second space.

The core is removed from the mold after solidification of the covering material. The upper mold is removed by lifting of the bottom plate or the like. At the same time, the masonry unit is removed from the mold, the unit being covered with the solidified covering material on the upper and lower faces (if desired, the upper, lower and both end faces) and the inner surface of the hole.

More preferably, the mold is provided with stepped parts, joiners, chamfers, raised parts, depending parts or the like, which protrude or expand to the space in the mold in order to make edging of the masonry unit. With such an arrangement, the covering layers on the upper and lower faces and so forth can be definitely separated or divided from the face of the unit (front and rear faces) uncovered with the covering material.

As the fluidic covering material, cement paste is preferably used, which is obtained by mixing of cement such as portland cement, fine aggregate and water (if desired, admixture is also mixed). As the preferably used admixture, AE agent, air entraining and water reducing agent, air entraining and high-range water reducing agent, plasticizer, high-molecular chemical admixture, viscosity improver, high-early-strength agent, water-proofing agent and so forth are exemplified. As the preferably used fine aggregates, fly-ash (coal ash), micro powder made from fly ash, silica fume, granulated blast-furnace fine powder and so forth are exemplified.

The cement paste including a relatively large amount of fly ash can be preferably used as the covering material (for example, cement paste mixture containing 185 kg of water, 285 kg of portland cement and 455 kg of fly ash). Use of fly ash is favorable from an aspect of recycling of waste, since a by-product of a coal-fueled power plant can be effectively used. Further, fluidity of the covering material is obtained by action of fly ash promoting fluidity, and therefore, use of fly ash is advantageous for densely charging the material within the space in the mold.

Resin mortar, fiber reinforced concrete or the like may be used as the covering material. As the covering material other than the fluidic material having portland cement as main component, it is possible to use fluidic material which has blended cement, gypsum, lime, dolomite plaster, synthetic resin or the like, as main component.

Preferably, the thickness of the covering material is set to be in a range of 2 mm-5 mm. The components, mixing ratio and thickness of the covering material can be appropriately changed in accordance with the sort of the masonry unit, the condition of its production, the condition of its use, or the like.

According to experimental findings of this inventor, in a case where a thin covering layer of 2-5 mm thickness is formed on a brick by conventional cement mortar, a number of cracks were apt to appear during setting of the cement mortar, in relation to the water absorbing property of the brick. On the other hand, in a case where cement paste with the fly ash (coal ash) being mixed therein as aggregate is used as set forth above, cracks does not appear on the surface. Therefore, use of the cement-type covering material with fly ash (coal ash) mixed therein as fine aggregate is effective especially in this invention. In such a case, it is preferred that the cement paste includes at least 3% (weight ratio), preferably at least 5% (weight ratio) of fly ash. In the experiment of the present inventor, the specific gravity, the compressive strength and the elastic modulus of the cement paste after solidification are as follows:

Specific Gravity: approx. 2.3
Compressive Strength (curing 28 days): 20-50N/mm$^2$
Elastic Modulus (curing 28 days): 2-3×10$^4$N/mm$^2$

BEST MODE FOR CARRYING OUT THE INVENTION

With reference to the attached drawings, a preferred embodiment of the present invention is described hereinafter.

Figure 1:
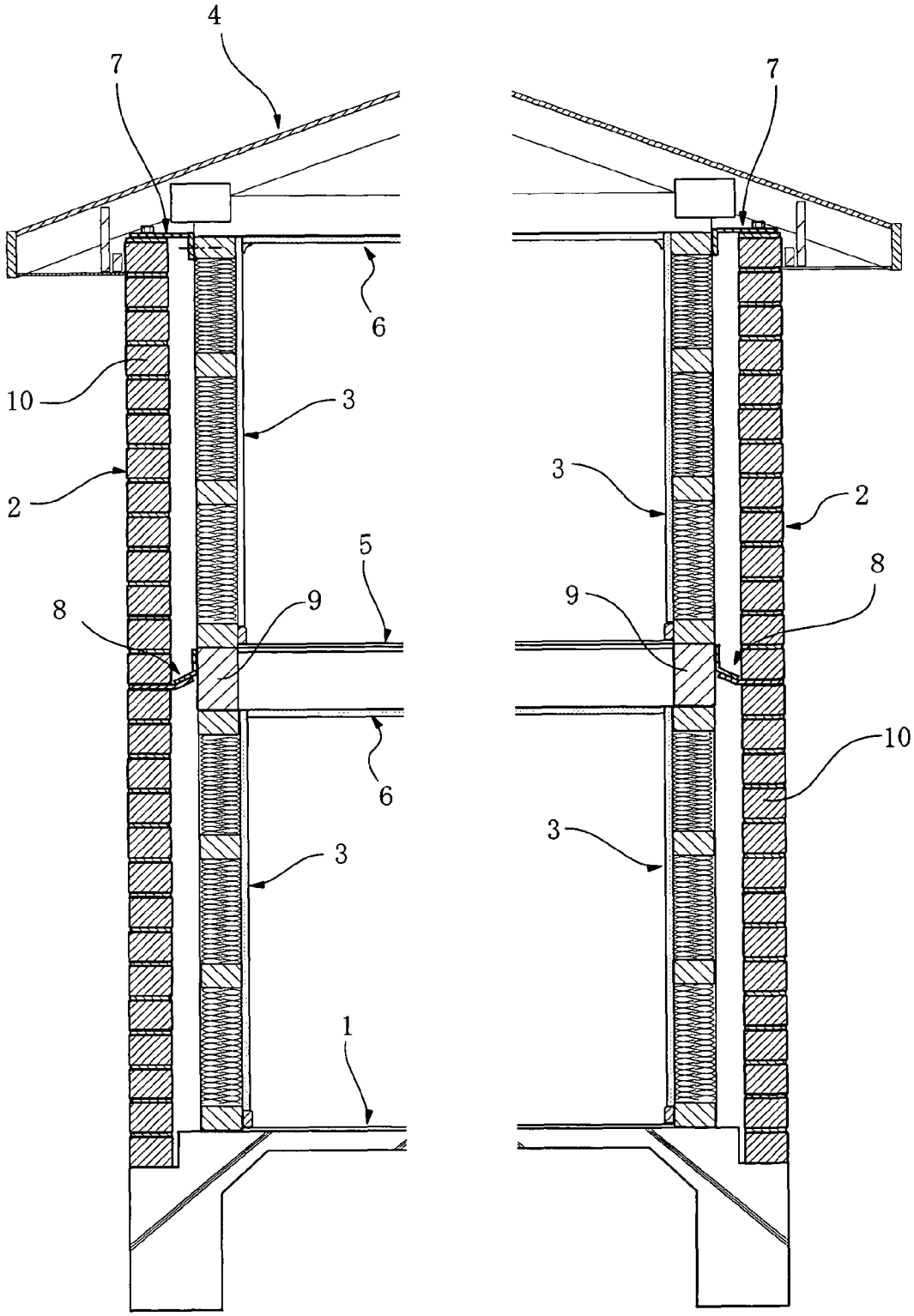
FIG. 1 is a cross-sectional view illustrating an architecture which has brick walls constructed in accordance with DUP Construction Method.

FIG. 1 is a cross-sectional view illustrating an architecture with brick walls constructed in accordance with DUP Construction Method.

The architecture is provided with a foundation and floor slab 1, outer walls 2, inner walls 3, a second floor framing 5, ceilings 6, a roof truss 4, and roofing materials (not shown). The outer walls 2 are brick walls laid on the foundation and floor slab 1 in accordance with the DUP Construction Method. The inner walls 3 are constructed by wooden panels which are conventionally used in a two-by-four wooden construction. The walls 3 are built up on the foundation and floor slab 1. The roof truss 4 is supported by upper ends of the inner walls 3. The roofing materials are provided on an upper surface of the roof truss 4. The load of the roof truss 4 acts on the inner walls 3 as a vertical load, which are supported by the load-carrying capacity of the inner walls 3.

Outside end portions of shear reinforcement metal parts 7 are secured to uppermost end portions of the outer walls 2.

The metal parts 7 horizontally extend toward the inner walls 3. An inner end portion of each of the metal parts 7 is bent downward at a right angle and connected to an upper end portion of the inner wall 3. The second floor framing 5 and the upstairs inner wall 3 are supported by horizontal members 9. The horizontal members 9 are connected with the outer wall 2 by shear reinforcement means 8 for transmission of stress. The horizontal load (seismic force and so forth) acting on the inner walls 3 and the roof truss 4 is transmitted to the outer walls 2 through the metal parts 7 and the reinforcement means 8, so that the load is supported by the resistance of the outer wall 2 against earthquakes.

Figure 2:
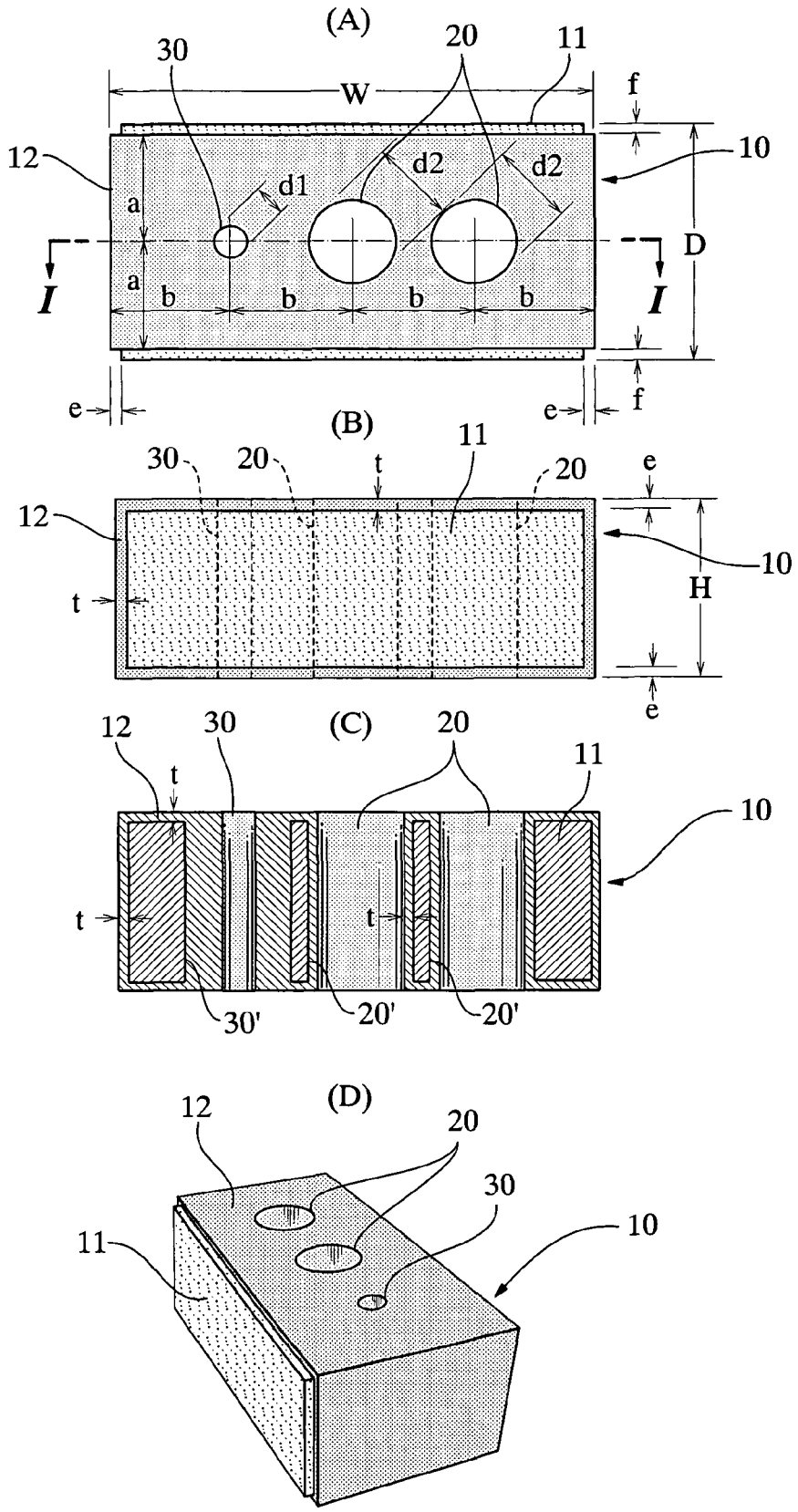
FIG. 2 includes a plan view, a front elevational view, a sectional view taken along a line I-I, and a perspective view of a regular brick which constitutes an outer wall.
Figure 3:
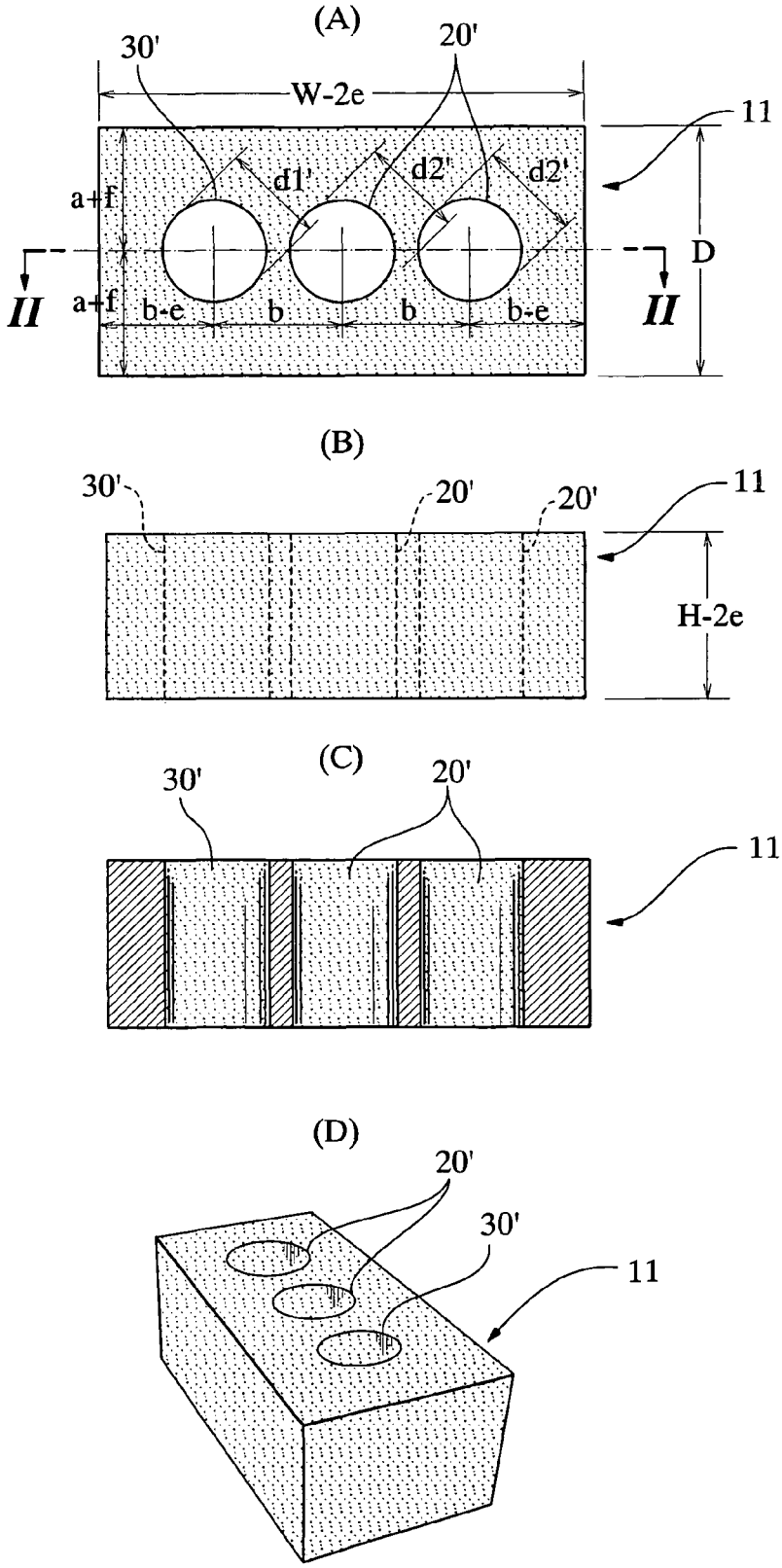
FIG. 3 includes a plan view, a front elevational view, a sectional view taken along a line II-II, and a perspective view of a brick body to be contained in a mold.

FIG. 2 includes plan, front elevational view, I-I sectional and perspective views of the regular or typical brick which constitutes the outer wall 2; and FIG. 3 includes plan, front elevational, II-II sectional and perspective views showing a configuration of the brick body (blank or basic form).

The brick 10 includes the brick body 11 integrally formed by baking of clay at a high temperature, and covering layers 12 on upper, lower, left end and right end faces of the body 11. Hollow sections 20 and a bolt hole 30 are longitudinally arranged in alignment with each other, which vertically extend through the brick 10. Inner circumferential surfaces of the section 20 and the hole 30 are also covered with the covering layers 12.

The covering layer 12 is a solid matter made by solidification of fluidic cement material, which is obtained by mixing and agitating cement, aggregate and water (if desired, admixture is also mixed). AE (air entraining) agent, air entraining and water reducing agent, air entraining and high-range water reducing agent, plasticizer, high-molecular chemical admixture, viscosity improver, high-early-strength agent, waterproofing agent and so forth are exemplified as applicable admixtures. Fly-ash (coal ash), micro powder made from fly ash, silica fume, granulated blast-furnace fine powder and so forth are exemplified as applicable fine aggregates. The mixing ratio of the cement, fine aggregate and water is appropriately determined in accordance with the configuration of the brick 10, condition of production, condition of use and so forth.

The dimensions (mm) of the brick 10, the layer 12, the section 20 and the hole 30 in this embodiment are set to be as follows:

Width W×Depth D×Height H of the brick: 220 mm×110 mm×85 mm

Locations a, b of the centers of the bolt hole and the hollow section: 55 mm, 55 mm Diameter $d_1$, $d_2$ of the bolt hole and the hollow section: 16 mm, 40 mm Dimensions of edge e, f: 5 mm Thickness of covering material t: 5 mm As is apparent from these values of dimension, the brick 10 have a proportion of an aspect ratio of 1:2 (planar dimensional ratio), and its half part has a square configuration as seen in the plan view. The centers of the sections 20 and the hole 30 are positioned on the center line of the brick 10, spaced apart an equivalent distance from each other in a direction of the width (W) of the brick 10. The hole 30 is positioned at a center of the half part (left half as seen in the drawings) of the brick 10, whereas the section 20 is positioned at a center of the other half part (right half as seen in the drawings) of the brick 10.

The body (blank or basic form) 11 is a normal brick produced generally in a rectangular form by baking, as shown in FIG. 3. The body 11 is formed with the through-holes 20', 30' which have relatively large circular cross-sections and which are spaced at an equal interval. The bricks with such configurations are relatively easily available on the market, as conventional brick products baked in accordance with conventional production methods.

The diameters $d_1'$, $d_2'$ of the through-holes 30', 20' are set to be $d_2+2\times t$. Therefore, the body 11 is formed with the holes 30', 20' which have the same diameter $d_1'$, $d_2'(=d_2+2\times t)$ and which are spaced an equal distance b from each other on the center line of the body 11.

Figure 4:
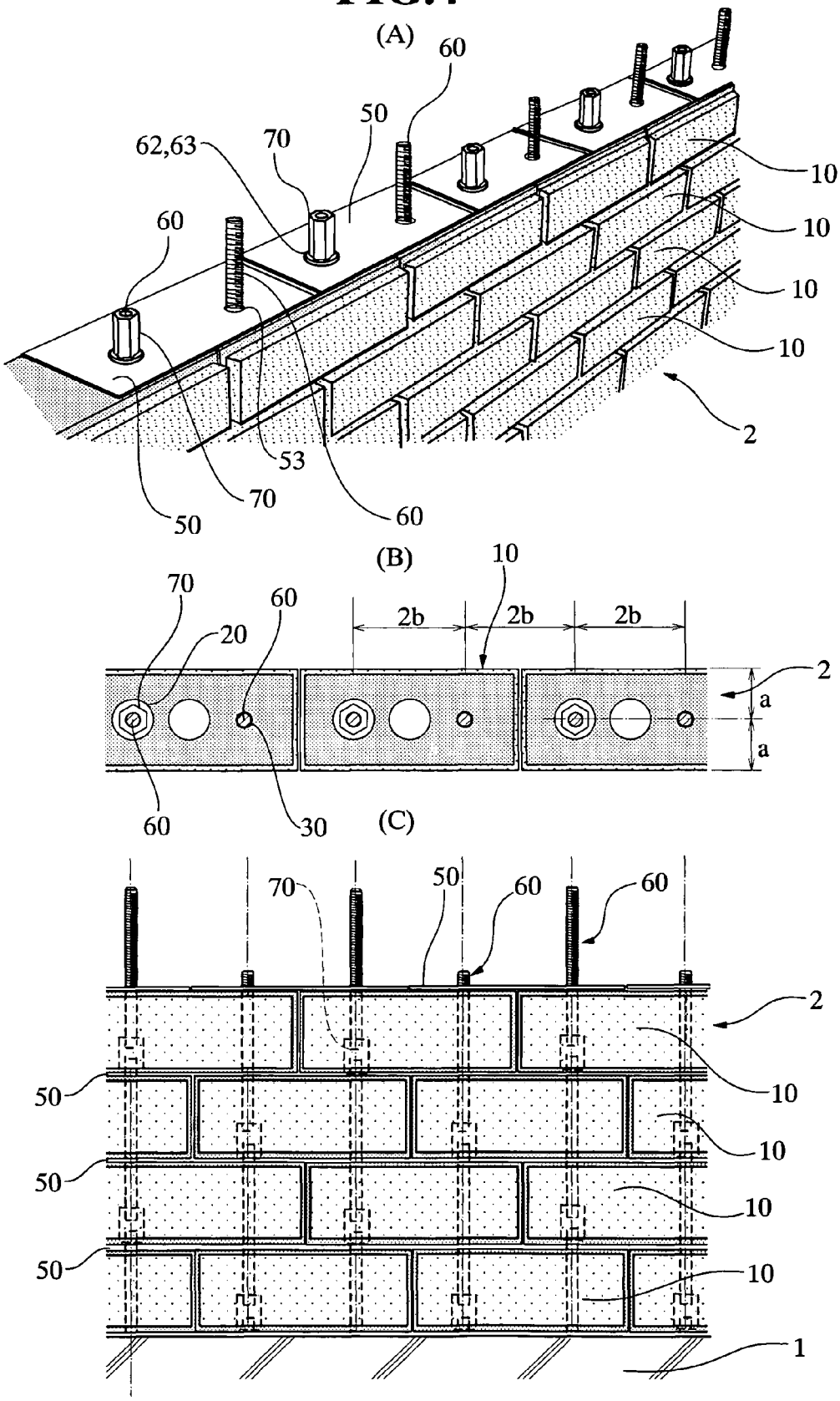
FIG. 4 includes a perspective view, a plan view and a front elevational view generally showing a bricklaying structure.

FIG. 4 includes perspective, plan and front elevational views showing a bricklaying structure of the outer wall 2.

In FIG. 4, a condition of the bricks 10 laid on the reinforced concrete foundation 1 is illustrated in a four-layered formation. Metal plates 50 with bolt holes 53 are interposed between the upper and lower bricks 10. Nuts 70 are inserted into the hollow section 20. Bolts 60, which are inserted through the holes 30, 53, are screwed into the nuts 70. The bolts 60, spring washers 62, circular washers 63 and long nuts 70 are assembled together, so that the bricks 10 and the plates 50 are integrally laid by tightening torque on the fastening elements 60; 62; 63; 70. As shown in FIGS. 4(B) and 4(C), the bolts 60 and the nuts 70 are alternately arranged on the center line of the brick wall (the outer wall 2), spaced apart an equal distance (2*b*) from each other. If desired, horizontal and vertical joints between the vertically or horizontally adjacent bricks 10 are filled with joint filler such as sealing compound.

Figure 5:
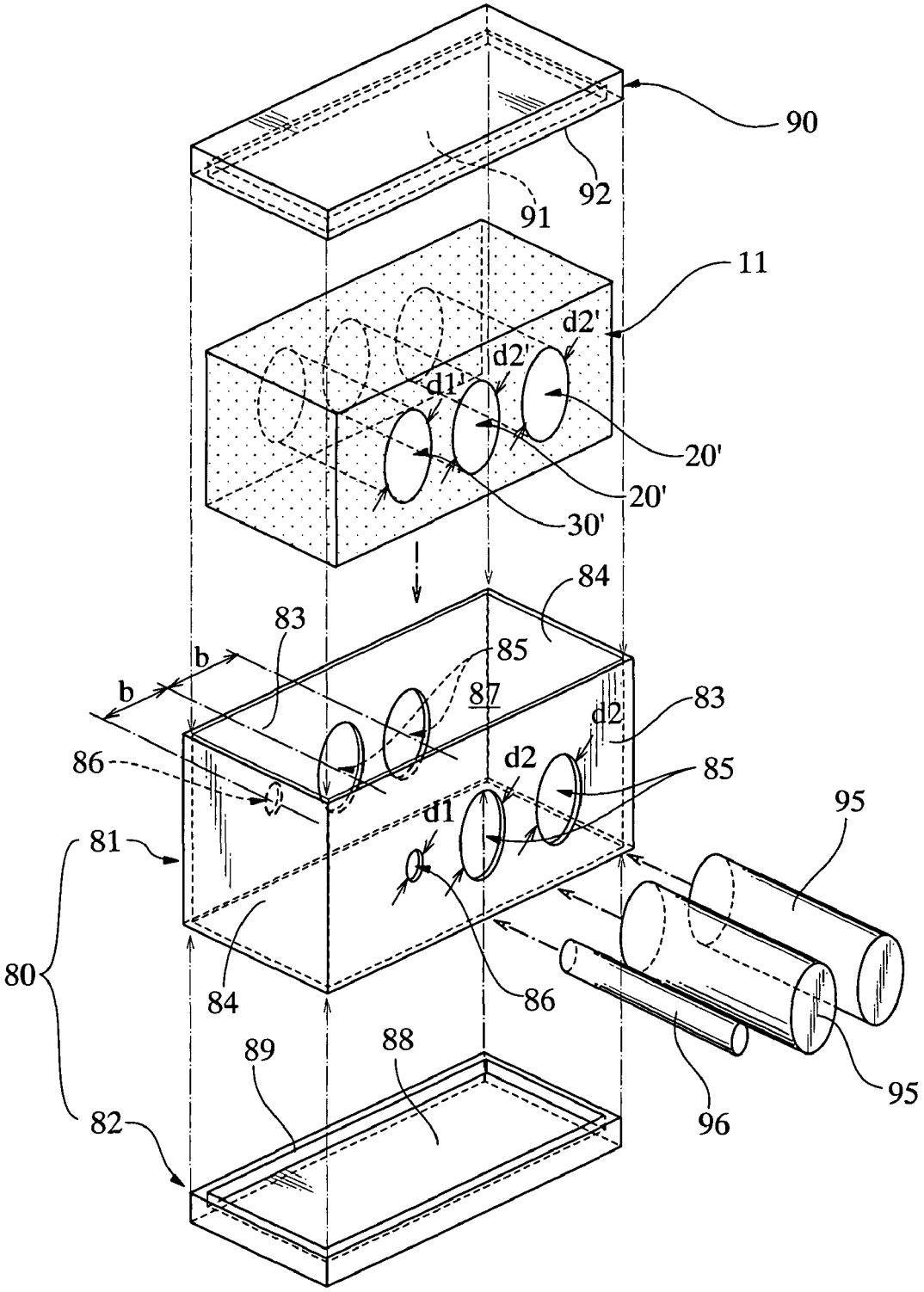
FIG. 5 is a perspective view showing the mold for forming a brick.

FIG. 5 is a perspective view showing the mold for forming the brick 10, and FIGS. 6 to 10 include longitudinal and cross sectional views showing a process of forming the brick 10.

A steel mold for forming the brick 10 is shown in FIG. 5. The mold comprises a top-opening lower mold part 80 for containing the body 11 of the brick 10, and an upper mold part 90 for closing the opening of the mold part 80.

Figure 6:
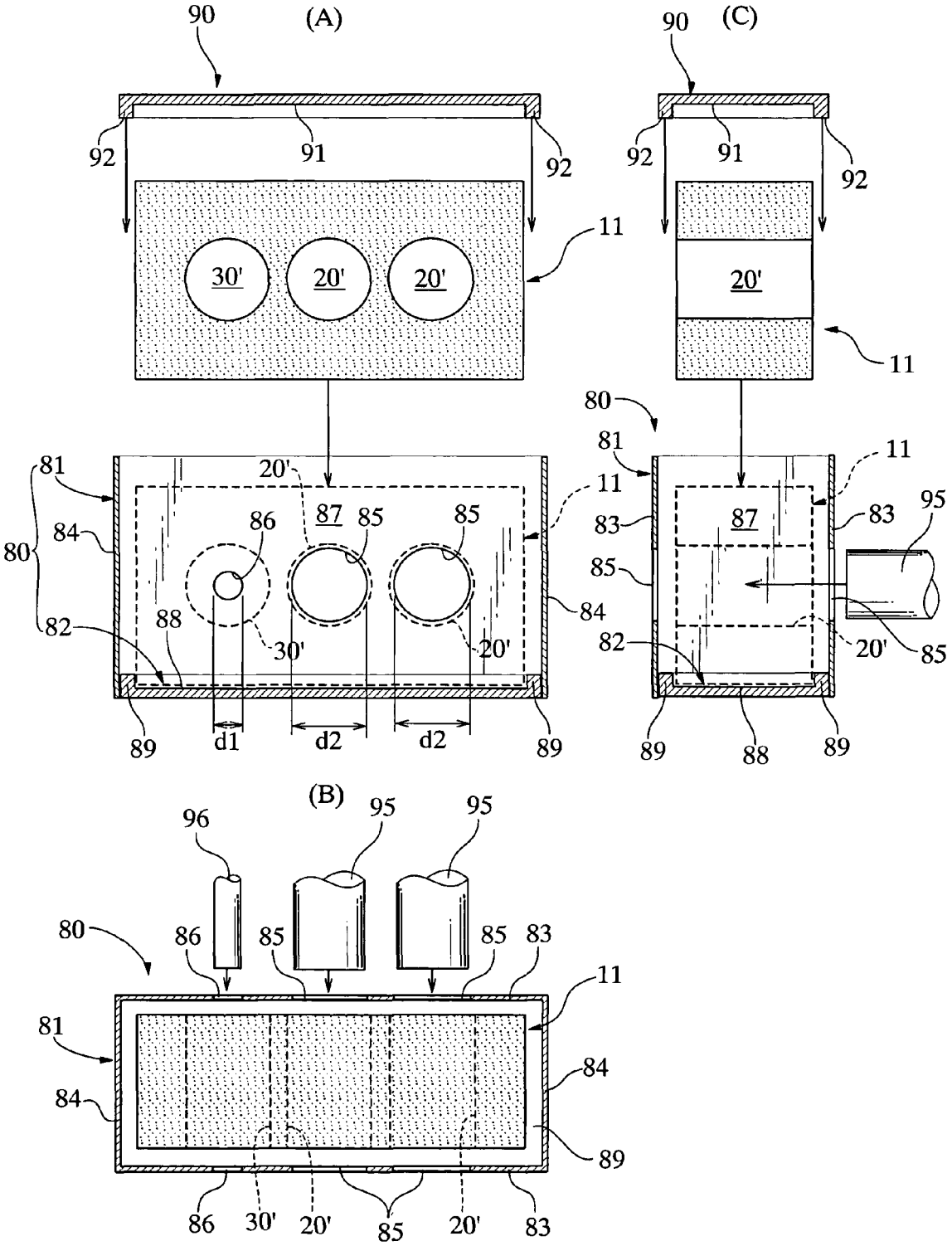
FIGS. 6, 7, 8, 9 and 10 include longitudinal and cross sectional views showing a process of forming the brick, wherein a condition before closing of the mold is illustrated in FIG. 6, a condition before injection of covering material is illustrated in FIG. 7, a condition during injection of the covering material is illustrated in FIG. 8, a condition of extraction of a core is illustrated in FIG. 9, and a condition of removal of the form is illustrated in FIG. 10.

The lower mold part 80 has a rectangular casing 81 and a movable bottom plate 82 which can be assembled together to define a top-opening molding space 87. The casing 81 has a rectangular frame structure which has right and left side plates 83 and end walls 84 integrally assembled. The bottom plate 82 has an outline in plane view insertable into the bottom opening of the casing 81, wherein plane dimensions of the bottom plate 82 are substantially the same as the internal dimensions of the casing 81. As shown in FIG. 6, the bottom plate 82 inserted in the casing 81 is in slidable contact with an inner wall surface of the casing 81, so that the plate 82 is held in the frame of the casing 81 vertically movably. The bottom plate 82 is formed with a raised zone 89 having a quadrate cross-section, which is elevated from a horizontal bottom surface 88 on a periphery of the plate 82. The cross-sectional dimensions of the zone 89 are so set as to correspond to the dimensions e, f of the edge part of the brick 10.

Figure 7:
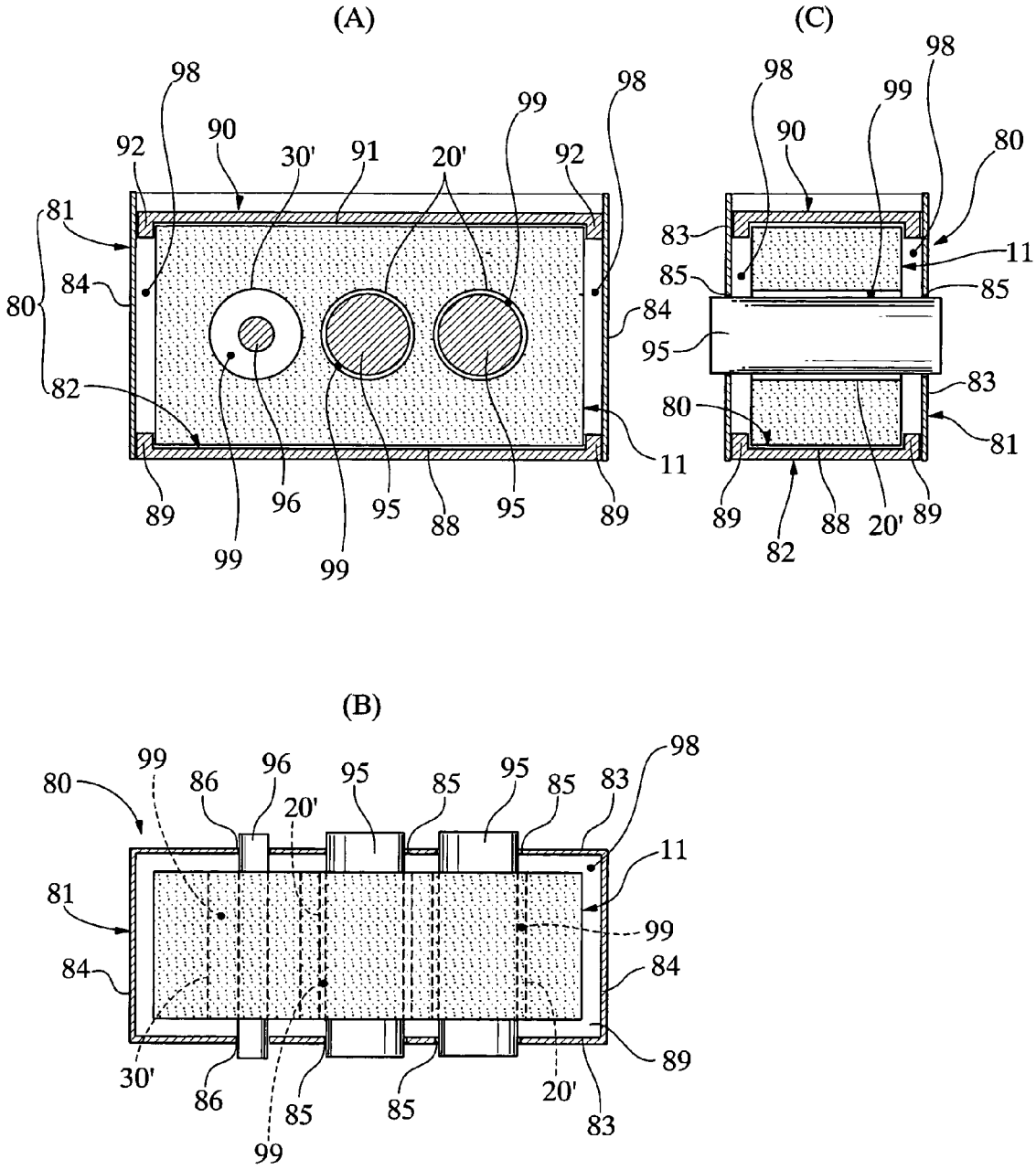

The upper mold part 90 has a profile and dimensions in plane view substantially the same as those of the bottom plate 82. As shown in FIG. 7, the mold part 90 is downwardly inserted into the casing 81. The mold part 90 closes the molding space 87 in the lower mold part 80 and is in slidable contact with the inner wall surface of the casing 81. The mold part 90 is formed with a depending zone 92 having a quadrate cross-section, which depends from a horizontal top face 91 on a periphery of the mold part 90. The cross-sectional dimensions of the zone 92 are so set as to correspond to the dimensions e, f of the edge part of the brick 10.

As shown in FIG. 5, the side plates 83 of the lower mold part 80 are formed with circular openings 85, 86, into which cylindrical cores 95, 96 can be inserted. The openings 85, 86 on one side are opposite against the openings 85, 86 on the other side respectively, so that the lower mold part 80 has an arrangement symmetrical with respect to the longitudinal center line. The distance between the centers of the openings 85, 86 is set to be the value b, which is the same as the distance between the centers of the hollow sections 20 and the holes 30. The cores 95, 96 are round bars or cylindrical parts made of steel. The centers of the openings 85, 86 are positioned to be in alignment with the centers of the holes 20', 30' of the body 11 inserted in the mold.

In the molding process, the cores 95, 96 act as inserts for forming the internal circumferential surfaces of the hollow sections 20 and the hole 30. The openings 85, 86 act as guiding and holding means for positioning and holding the cores 95, 96 in predetermined locations of the mold. The diameter of the opening 85 is set to be the diameter $d_2$ identical with the diameter of the hollow section 20 of the brick 10 (FIG. 2), and the outer diameter of the core 95 is substantially the same as the diameter $d_2$ or slightly smaller than the diameter $d_2$. The diameter of the opening 86 is set to be the diameter $d_1$ identical with the diameter of the bolt hole 30 of the brick 10 (FIG. 2), and the outer diameter of the core 96 is substantially identical with the diameter $d_1$ or slightly smaller than the diameter $d_1$.

At the beginning step (step of setting of the lower mold part), the bottom plate 82 is inserted into the casing 81 through its bottom opening so that the plate 82 defines the bottom wall of the mold as shown in FIG. 6. The body 11 of the brick 10 takes a position in that the holes 20', 30' open on the sides (a posture oriented sideways). The body 11 is vertically inserted into the molding space 87 through the top opening of the casing 81. The body 11 is seated on the horizontal bottom surface 88 as shown in FIG. 6. The plane dimensions of the bottom surface 88 are substantially identical with the front side dimensions (W−2e)×(H−2e) of the body 11. The body 11 is placed in a predetermined position within the molding space 87 by the raised zone 89 of the bottom plate 82.

The cores 95, 96 are inserted through the openings 85, 86 into the holes 20', 30' of the body 11. The upper mold part 90 is inserted into the molding space 87 through the top opening of the casing 81. As shown in FIG. 7, the cores 95, 96 are secured at the center of the holes 20', 30' and the upper mold part 90 closes the inside space of the mold to form a top wall of the space. Thus, a cavity 98 for injection of the covering material is defined between the side plates 83 and the upper and lower faces of the body 11, and is defined between the end walls 84 and the end walls of the body 11. An annular cavity 99 for injection of the covering material is defined between the inner circumferential surfaces of the holes 20', 30' and the outer circumferential surfaces of the cores 95, 96. The cavities 98, 99 form a continuous space in communication with each other in the mold.

Figure 8:
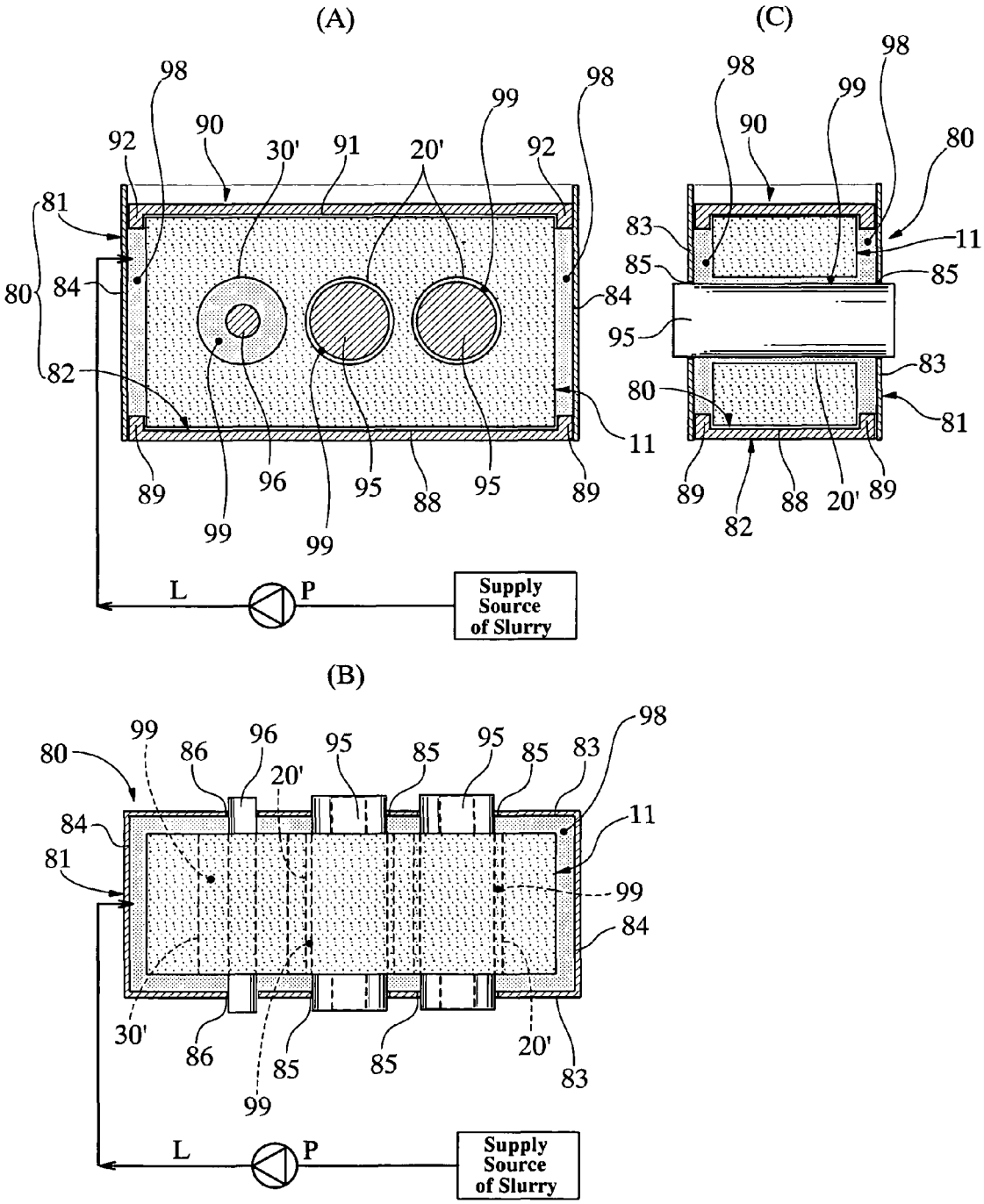

The casing 81 is provided with a slurry injection gate (not shown). As shown in FIG. 8, the gate is connected with a supply source of slurry by means of a slurry delivery tube L provided with a pump P for pumping the slurry. The fluidic cement material having appropriate fluidity is delivered from the source to the gate under pressure of the pump P, and is injected into the mold through the gate. The fluidic material flows in the inside space of the mold to be charged in the cavities 98, 99.

Figure 9:
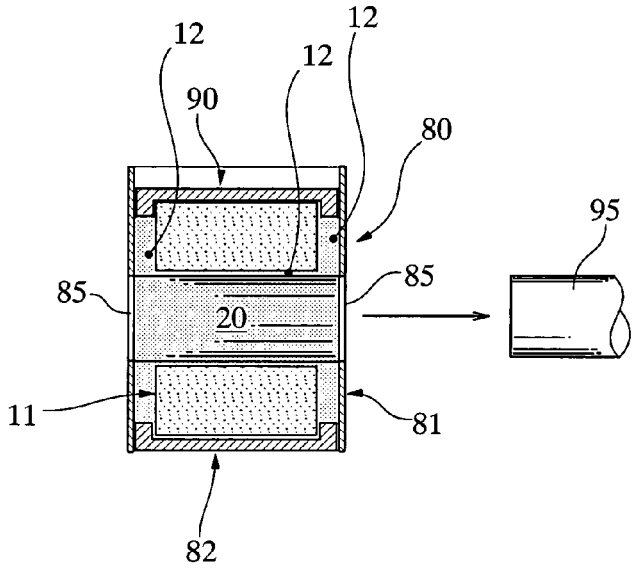
Figure 10:
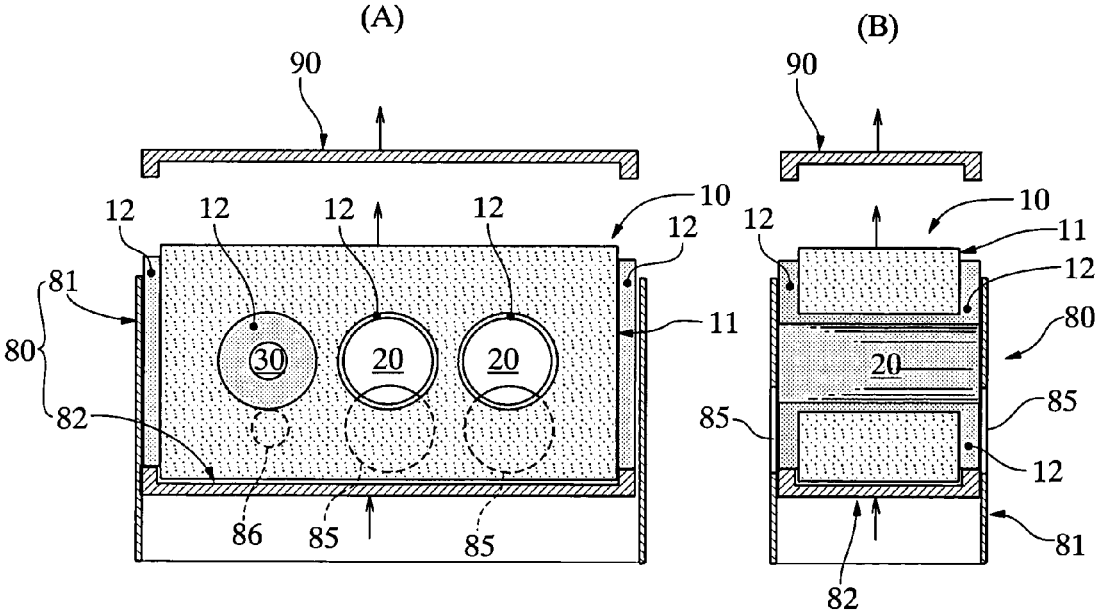

When a predetermined slurry setting time passes after injection of the fluidic cement material, a removal step of the brick 10 is carried out. In the removal step, the cores 95, 96 are extracted from the mold as shown in FIG. 9, and then, as shown in FIG. 10, the bottom plate 82 is lifted by a lifting mechanism (not shown). A fluid-operated (pneumatic or hydraulic) cylinder device, or a driving device provided with any type of primary drive such as an electric motor can be employed as the lifting mechanism. The bottom plate 82 is pushed upward by a driving force of the lifting mechanism. The brick 10 is lifted under pressure of the bottom plate 82. The upper mold part 90 is lifted under pressure of the brick 10. The brick 10 thus removed from the mold has upper, lower and end faces covered with the covering layer 12 of the solidified cement material, and the holes 20', 30' is provided with the inside circumferential surface of the covering layer 12 of the solidified cement material. Accuracy of the upper and lower faces of the brick 10 is better than (within) the standard deviation of 0.118 mm and accuracy of the end faces of the brick 10 is better than (within) the standard deviation of 0.142 mm. Therefore, the dimensions of the brick 10 are highly precise. Further, the brick 10 is provided with the hollow sections 20 and the bolt hole 30 having precise dimensions and located in precise positions. The bricklaying process of the brick 10 thus formed is illustrated in FIG. 11.

Figure 11:
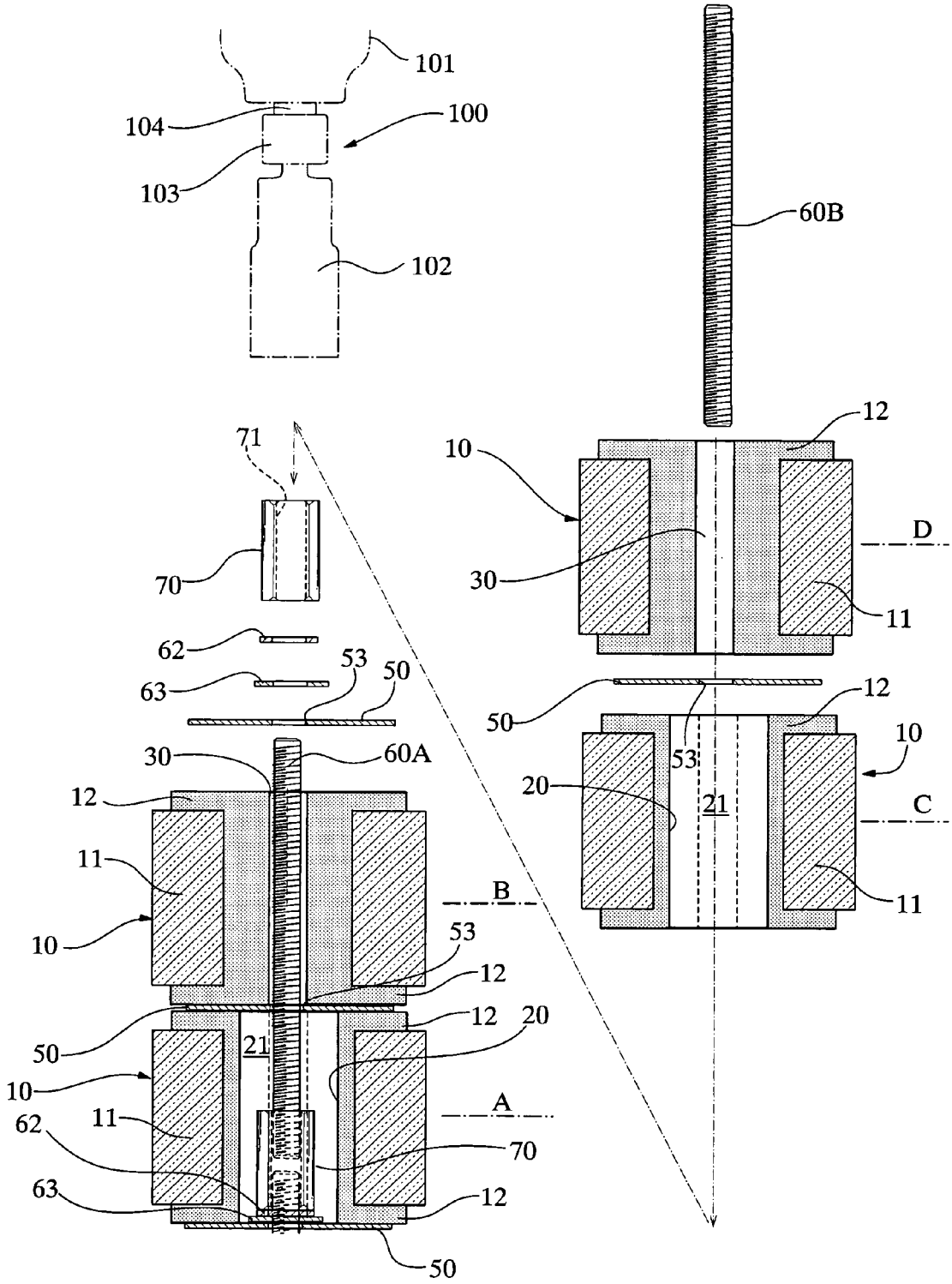
FIG. 11 is a cross sectional view showing a bricklaying process of the bricks thus formed.

As shown in FIG. 11, the metal plate 50 is interposed between a first stage A of the bricks 10 and a second stage B thereof. The bolt holes 53 of the plate 50 are in alignment with the hollow section 20 and the bolt hole 30. A fully screw-cut bolt 60A, which has a height (length) equivalent to the height of two-layered bricks, extends through the hollow section 20 and the bolt holes 30, 53. A long nut 70 engageable with the bolt 60A is positioned in a hollow area 21 of the hollow section 20. A lower end portion of the bolt 60A is screwed into the nut 70 and tightened thereto.

The plate 50 is further placed on the upper face of the laid bricks 10 (first and second stages A:B). The washers 62, 63 are placed on the plate 50 to be in alignment with the hole 53. An upper end portion of the bolt 60A extends through the hole 53 and the washers 62, 63 and protrudes upward. An internal thread 71 of the long nut 70 is screwed on the upper end portion of the bolt 60A.

A specific fixing tool 100 as illustrated by phantom lines in FIG. 11 is used for tightening the nut 70 onto the bolt 60A. The tool 100 is provided with a portable driving part 101, a socket part 102 selectively engageable with the bolt 60 and the nut 70, and a joint part 103 which can integrally connect the proximal portion of the socket 102 with a rotary shaft 104 of the driving part 101. The socket part 102 receives the nut 70 for transmitting the torque of the part 101 to the nut 70, thereby rotating the nut 70 in its tightening direction. The nut 70 rotates with respect to the bolt 60A so that the nut 70 is securely tightened onto the upper end portion of the bolt 60A.

In a succeeding bricklaying step, the brick 10 for an upper stage (third stage C) is further laid on the brick 10 of the lower stage (second stage B). The nut 70 is contained in the hollow section 20, and the metal plate 50 is laid on the brick 10 (third stage C), and then, the brick 10 of a further upper stage (fourth stage D) is laid on the plate 50. A bolt 60B is inserted into the bolt hole 30 of the uppermost brick 10 (fourth stage D), and a lower end portion of the bolt 60B is screwed into the nut 70. The aforementioned fixing tool 100 is also used for tightening the bolt 60B into the nut 70.

Figure 12:
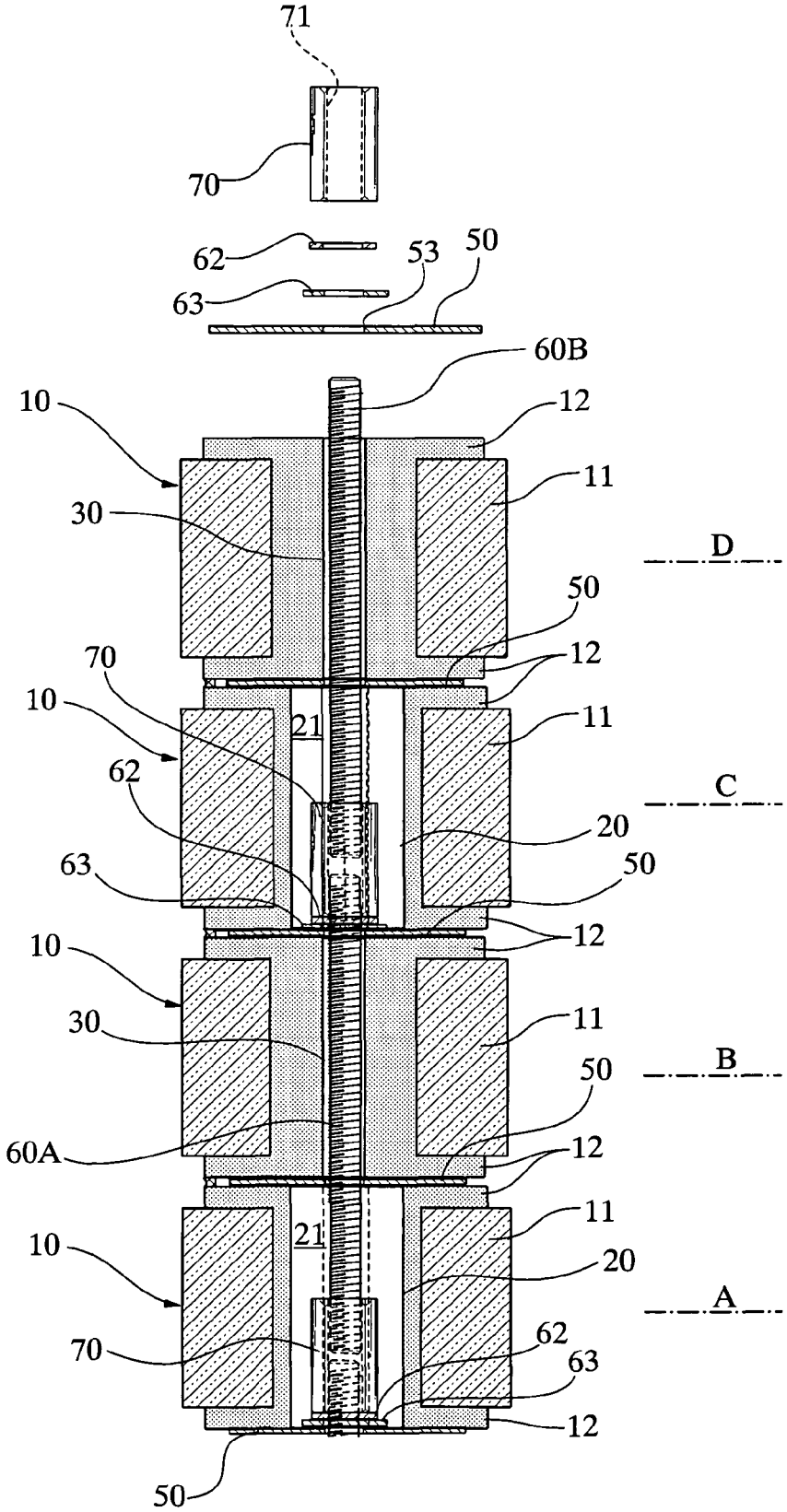
FIG. 12 is a cross sectional view illustrating the brick wall constructed by the bricks laid in four-layers formation.

The brick-laid condition of the bricks 10 (the first-fourth stages A:B:C:D) thus constructed is shown in FIG. 12. Tensile stress corresponding to the tightening torque acts as prestress on the bolt 60 screwed at its upper and lower end portions into the nuts 70, whereas compressive stress acts as prestress on the brick 10 between the upper and lower plates 50. If desired, the joints between the bricks 10 are filled with joint filler such as sealing compound.

In such a bricklaying process, the bricks 10, the plates 50 and the fastening elements 60; 62; 63; 70 are precisely assembled integrally by a predetermined tightening torque, since each of the brick 10 has flat and smooth horizontal upper and lower surfaces of the covering layers 12 formed with high accuracy.

Figure 13:
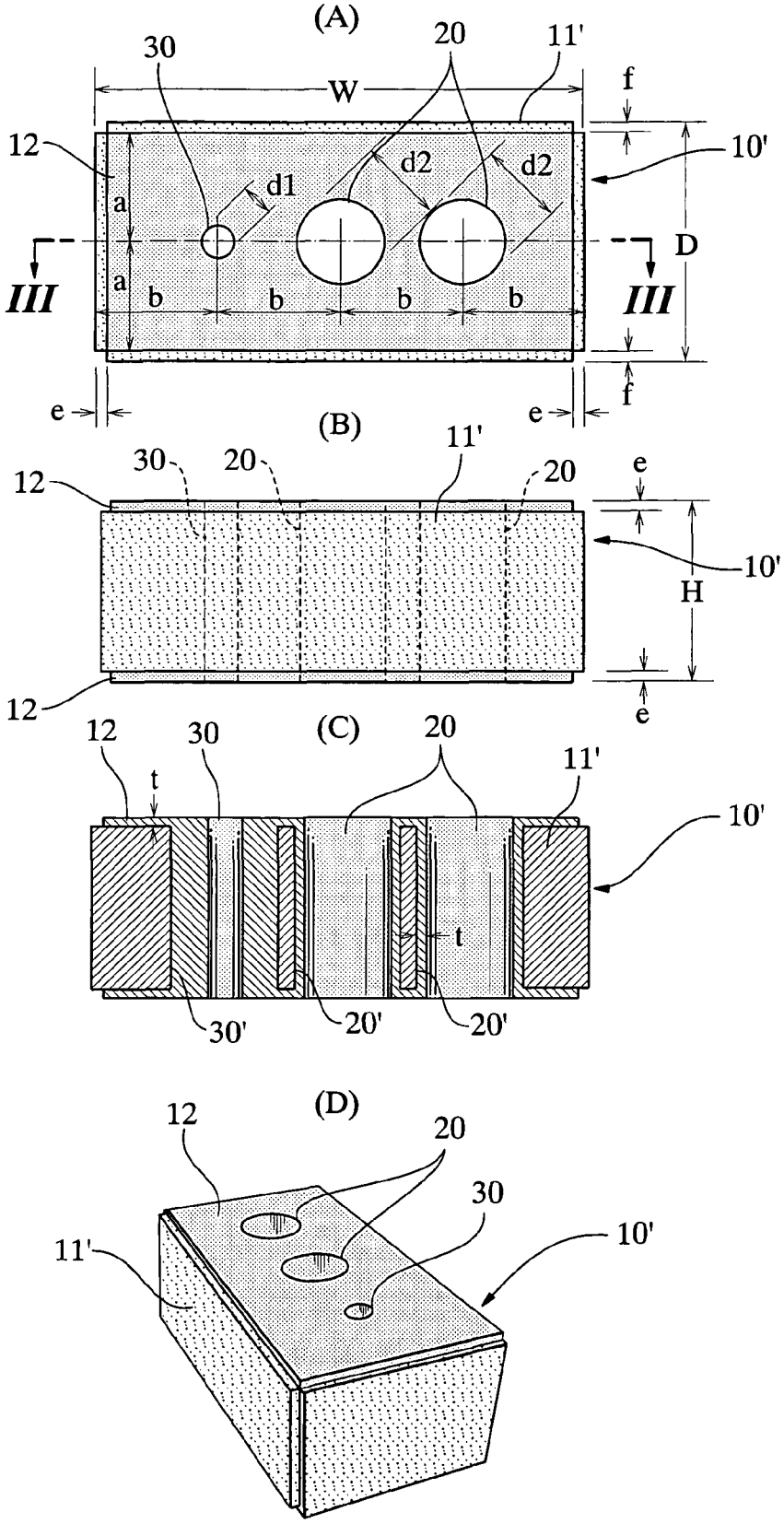
FIG. 13 includes a plan view, a front elevational view, a sectional view taken along a line III-III, and a perspective view showing a structure of a brick with another configuration which constitutes the outer wall.
Figure 14:
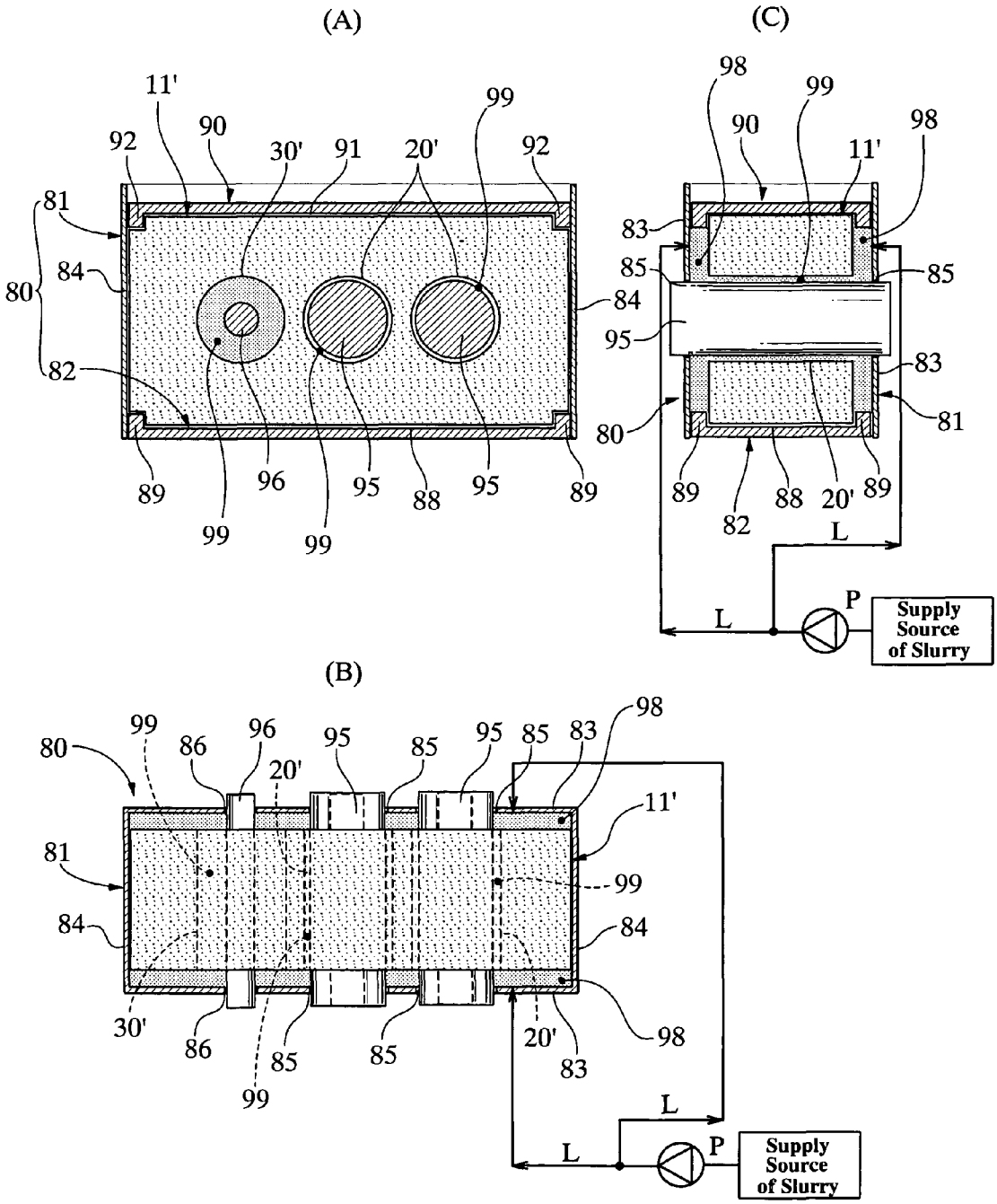
FIG. 14 includes longitudinal and cross sectional views showing a process of forming the brick as shown in FIG. 13.

FIG. 13 includes plan, front elevational, III-III sectional and perspective views showing a structure of another form of brick which constitutes the outer wall 2, and FIG. 14 includes longitudinal and cross sectional views showing a process of forming the brick 10' as shown in FIG. 13, wherein the elements or constituents which are substantially the same as those shown in FIGS. 2 to 12 are indicated by the same reference numerals.

The brick 10' as shown in FIG. 13 is provided with the covering layer 12 on upper and lower surfaces of its body 11'. The covering layer 12 also covers the inner circumferential surfaces of the hollow section 20 and the bolt hole 30. The width of the body 11' coincides with the width W of the brick 10', and the covering layer 12 is not provided on the end faces of the brick 10. This kind of brick is preferably used, e.g., as a brick located on a wall part to expose its end face outside.

As shown in FIG. 14, the body 11' is contained in the mold which is substantially the same as the aforementioned mold. As previously described, the bottom plate 82 and the upper mold part 90 are inserted into the casing 81 through the bottom and top openings. The cores 95, 96 are inserted through the openings 85, 86 into the holes 20', 30' of the body 11'. The cores 95, 96 constitute the inserts for forming the inner circumferential surfaces of the hollow sections 20 and the bolt hole 30. The cavities 98, 99 for injection of the covering material are defined in the mold containing the body 11'. The fluidic cement material having an appropriate fluidity is delivered under pressure from the slurry supply source to the slurry injection gate by the pump P, so that the material is injected through the gate into the cavity 98, 99.

The fluidic cement material is charged in the cavities 98, 99. After setting of the material, the form removal step of the brick 10' is carried out as previously described and the brick 10' with the covering layer 12 thereon is removed from the mold.

Figure 15:
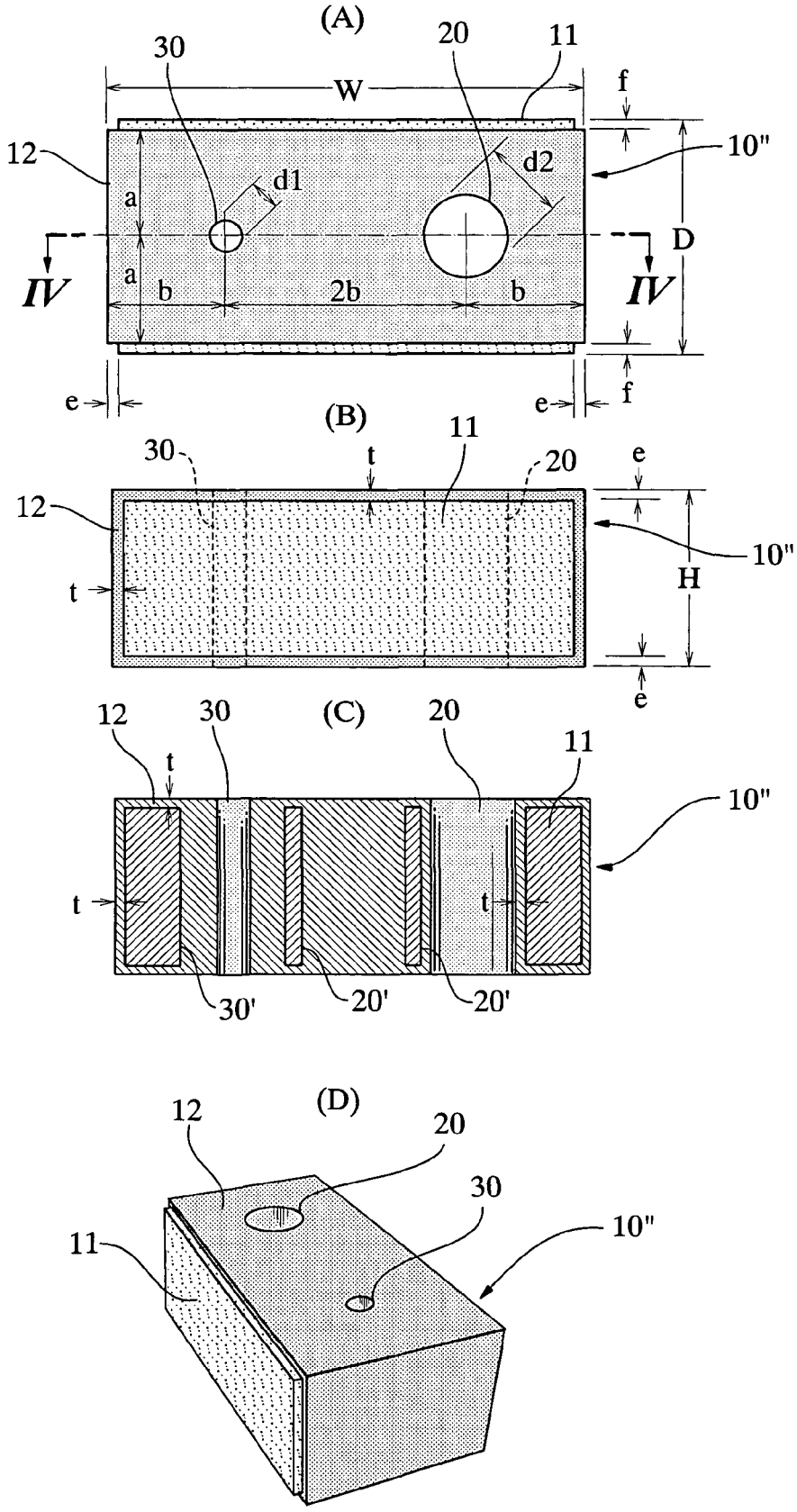
FIG. 15 includes a plan view, a front elevational view, a sectional view taken along a line IV-IV, and a perspective view showing a structure of brick with yet another configuration.
Figure 16:
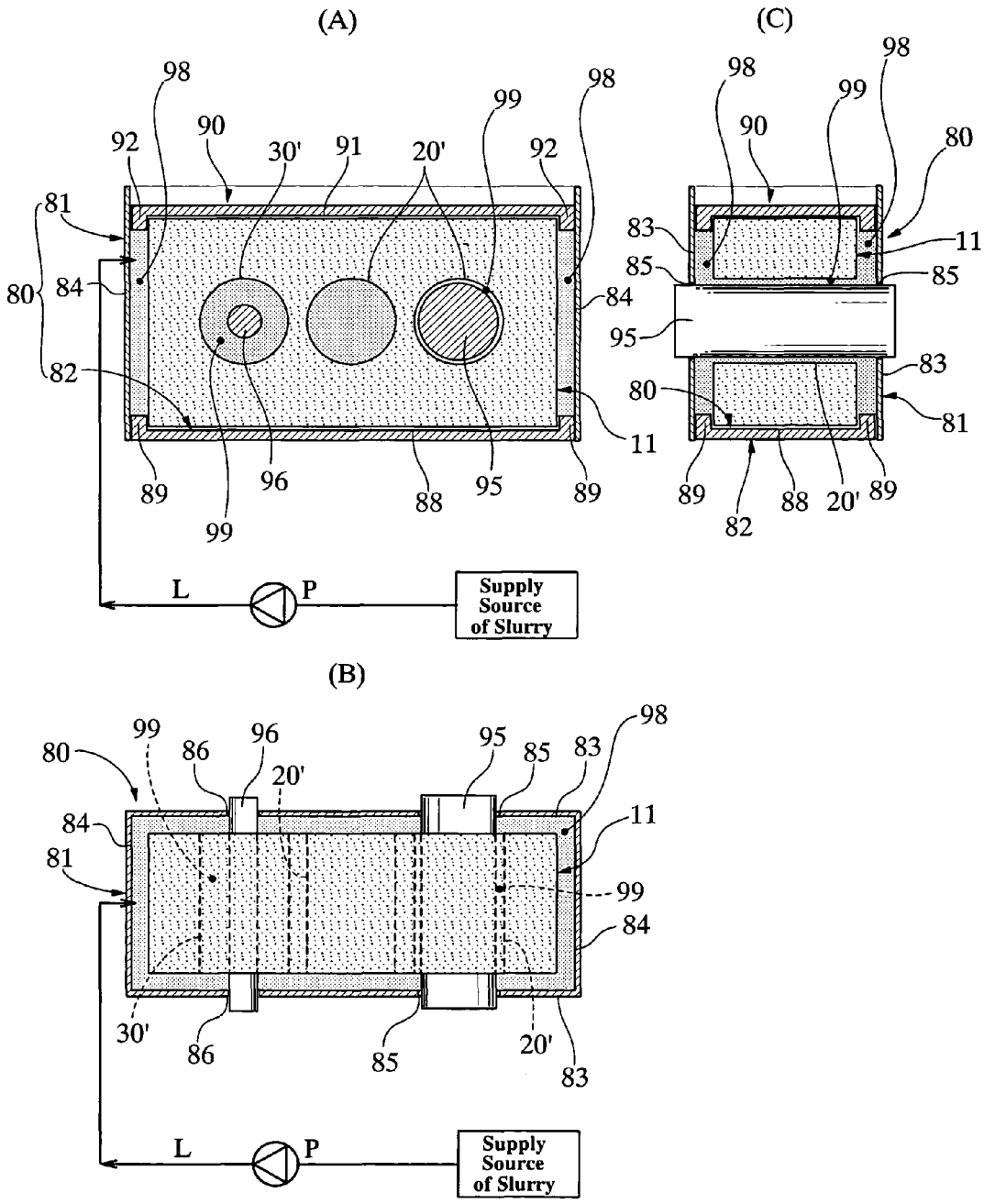
FIG. 16 includes longitudinal and cross sectional views showing a process of forming the brick as shown in FIG. 15.

FIG. 15 includes plan, front elevational, IV-IV sectional and perspective views showing a structure of yet another form of brick, and FIG. 16 includes longitudinal and cross sectional views showing a process of forming the brick 10" as shown in FIG. 15, wherein the elements or constituents which is substantially the same as those shown in FIGS. 2 to 12 are indicated by the same reference numerals.

The brick 10" as shown in FIG. 15 is provided with the covering layer 12 of the solidified cement material thereon, similarly to the embodiment as shown in FIGS. 2 to 12. The covering layer 12 covers the upper and lower surfaces of the body 11 and the inner circumferential surfaces of the hollow section 20 and the bolt hole 30.

As shown in FIG. 16, the side plates 83 of the lower mold 80 is not provided with the circular opening 85 for the through-hole 20' at the center of the body 11, and the core 95 inserted therethrough is not used. Therefore, the fluidic cement material is charged in the hole 20' (FIG. 3) at the center of the body 11. As the result, the brick 10" has the single bolt hole 30 and the single hollow section 20. That is, the number of the hollow sections 20 are reduced in comparison with the aforementioned embodiments, since the core is not inserted into one of the holes 20' so that the fluidic covering material injected into the cavities 98, 99 is charged into one of the holes 20'. The other structures and forming steps of the brick 10" are substantially the same as those of the embodiments as shown in FIGS. 1 to 12.

According to the forming method of the present invention, the brick body 11, 11' is contained in the mold to define the cavities for injection of the fluidic cement material, and the upper and lower faces (and the end faces) and the inner circumferential surfaces of the through-holes 20', 30' are covered with the solidified cement material. Therefore, the brick 10, 10', 10" can have the upper and lower surfaces formed with dimensionally high accuracy, and the hollow section 20 and the bolt hole 30 can be formed in the brick 10, 10', 10" with dimensionally and positionally high accuracy.

Although the present invention has been described as to the preferred embodiments, the present invention is not limited thereto, but may be carried out in any of various modifications or variations without departing from the scope of the invention as defined in the accompanying claims.

For insurance, an irregular brick, such as a corner brick used in a wall corner, a column part or the like, can be formed in accordance with the aforementioned forming method.

Further, the aforementioned method for forming the masonry unit for dry masonry construction method can be applied to conventional unit-types of building materials, such as a concrete block.

Additionally, a plurality of masonry units can be simultaneously formed by a plurality of molds connected with each other or a mold which has a plurality of molding spaces for containing a plurality of masonry units.

The mold may be provided with a channel for injection of slurry through which the slurry delivery tube is in communication with the slurry injection gate.

If high injection pressure is not required, the upper mold part may be omitted whereby the mold may be constituted only from the lower mold part.

In the aforementioned embodiments, the opening, through which the cores can be inserted, are provided in each of the side plates on both sides. However, it is possible to make the opening only in the side plate on one side. In a case where only the side wall on one side is provided with the opening, the mold may be preferably provided with positioning means for positioning a distal end of the core. For example, the side plate on the other side (the opposite side) or a distal end face of the core may be provided with a positioning pin, a pin engagement part or the like which positions the distal end of the core. Alternatively, an arrangement may be employed, in which an elastic member is attached to the distal end face of the core for securing the position of the core. The end portion of the core is pressed against the inside surface of the mold on the opposite side.

INDUSTRIAL APPLICABILITY

The method according to the present invention can be applied to a method for forming a masonry unit used for a dry construction method in which the structural strength depends on mechanical tightening force of the nuts and bolts. According to the present invention, it is possible to ensure high dimensional accuracy of each of the masonry units and promote efficiency of the production process of the masonry units to improve productivity of the masonry units.

Especially, the method according to the present invention is preferably applicable to production of the bricks to be used for the DUP Construction Method. According to the present invention, efficiency of the production process of the bricks for the DUP Construction Method can be promoted and productivity of the bricks can be improved.

Further, the present invention may be applied to a method for forming conventional unit-types of building materials, such as concrete blocks. According to the present invention, it is possible to efficiently produce masonry units which are used for a dry construction method and which enable masonry with high dimensional accuracy.

The invention claimed is:

1. A method for forming substantially flat and smooth horizontal surfaces on upper and lower faces of a masonry unit oriented in its position of intended use in a masonry construction in which a flat metal plate having an upper face and a lower face is interposed between upper and lower masonry units with the upper and lower faces of adjacent masonry units being in surface-to-surface contact with the upper and lower faces of the metal plate, and the upper and lower masonry units being integrally assembled by tightening force of fastening elements, extending through a vertical through-hole of the masonry unit, the masonry unit forming method comprising the steps of:

containing said masonry unit vertically in a mold with the masonry unit positioned so that the through-hole opens on both sides of the masonry unit and is oriented sideways, so that a space chargeable with a fluidic covering material is defined between said upper and lower faces of said masonry unit and vertical wall surfaces of the mold;

inserting a core into the through-hole;

charging the fluidic covering material in said space; and extracting the core from the through-hole and removing the masonry unit from the mold by lifting the masonry unit, when a predetermined setting time passes after charging the fluidic material, whereby the upper and lower faces of said masonry unit are covered with the solidified covering material to form the substantially flat and smooth upper and lower horizontal surfaces on the masonry unit.

2. The method as defined in claim 1, wherein, in the containing step, the masonry unit to be contained in the mold is a brick.

3. The method as defined in claim 2, wherein, in the containing step, the brick has a plurality of through-holes.

4. The method as defined in claim 3, further comprising the steps of: filling at least one of the through-holes, into which the core is not inserted, with said covering material by absence of the core, so that the number of through-holes in the unit is changed.

5. The method as defined in claim 1, wherein, in the containing step, said masonry unit is contained in the mold, and a space for charging covering material, which is chargeable with the fluidic covering material, is further defined between each of the end faces of said masonry unit and the surfaces of the mold.

6. A masonry unit produced by the method as defined in claim 5, wherein, in the extracting step, the accuracy of the end faces of the masonry unit is better than the standard deviation of 0.142 mm.

7. The method as defined in claim 1, wherein, in the containing step, the mold is made of metal.

8. The method as defined in claim 1, wherein, in the containing step, the mold is constituted from upper and lower mold parts, and the lower mold part comprises a rectangular frame which has four faces corresponding to upper, lower and end faces of said masonry unit, and a bottom plate which is combined with the frame for lifting movement.

9. The method as defined in claim 8, further comprising the steps of: forcibly lifting the bottom plate when said masonry unit is to be removed from the mold, so that the masonry unit is removed from the lower mold part under pressure of the bottom plate.

10. The method as defined in claim 1, wherein in the containing step, the mold is provided with a gate for injection of the fluidic covering material.

11. The method as defined in claim 1, wherein, in the containing step, a wall of said mold is formed with an opening for insertion of said core, through which the core is inserted, so that a second space to be charged with the covering material is defined between an outer surface of the core and an inner surface of said through-hole.

12. The method as defined in claim 1, wherein, in the containing step, the mold has a stepped part, a joiner, a chamfer, a raised part or a depending part, which protrudes or expands into the space in the mold in order to make edging of said masonry unit.

13. The method as defined in claim 1, wherein, in the charging step, the fluidic covering material including coal ash and cement is used as said covering material.

14. The method as defined in claim 1, wherein, in the extracting step, the thickness of said covering material is set to be at least 2 mm.

15. A masonry unit produced by the method as defined in claim 1, wherein, in the extracting step, the accuracy of the upper and lower faces of the masonry unit is better than a standard deviation of 0.118 mm.

* * * * *